US006491464B1

(12) United States Patent
Young

(10) Patent No.: US 6,491,464 B1
(45) Date of Patent: Dec. 10, 2002

(54) MULTI-ELEMENT PEN

(76) Inventor: Jean Young, 2F., No. 52. Tien Shui Road., Taipei City (CN)

( * ) Notice: Subject to any disclaimer, the term of this patent is extended or adjusted under 35 U.S.C. 154(b) by 0 days.

(21) Appl. No.: 09/982,774

(22) Filed: Oct. 22, 2001

(51) Int. Cl.[7] ..... B43K 27/04
(52) U.S. Cl. ..... 401/35; 401/17
(58) Field of Search ..... 401/23, 17, 18, 401/16, 34, 35, 20, 21, 52, 195, DIG. 36

(56) References Cited

U.S. PATENT DOCUMENTS

| | | | | | |
|---|---|---|---|---|---|
| 1,463,983 | A | * | 8/1923 | Visitacion | 401/17 |
| 1,938,835 | A | * | 12/1933 | Grzyb | 401/35 |
| 1,977,527 | A | * | 10/1934 | Pohle | 401/35 |
| 3,767,780 | A | * | 10/1973 | Guu et al. | 401/17 |
| 4,557,618 | A | * | 12/1985 | Iwata et al. | 401/34 |
| D295,537 | S | * | 5/1988 | Davidson et al. | D19/43 |
| D312,658 | S | * | 12/1990 | Sumino | D19/36 |
| 4,979,840 | A | * | 12/1990 | Madaus et al. | 401/202 |
| 5,017,034 | A | * | 5/1991 | Stary et al. | 401/35 |
| 5,033,895 | A | * | 7/1991 | Aida | 401/131 |
| 5,762,077 | A | * | 6/1998 | Griffiths, Jr. | 132/74.5 |
| D422,308 | S | * | 4/2000 | Chuang | D19/36 |
| 6,179,501 | B1 | * | 1/2001 | Fulop | 401/34 |

FOREIGN PATENT DOCUMENTS

| | | | | | |
|---|---|---|---|---|---|
| CH | 191868 | | * | 9/1937 | 401/17 |
| DE | 2643599 | A1 | * | 9/1976 | 401/34 |
| DE | 3504261 | A | * | 8/1986 | 401/34 |
| FR | 1251499 | | * | 1/1960 | 401/35 |

* cited by examiner

*Primary Examiner*—Robert M. Fetsuga
*Assistant Examiner*—Huyen Le
(74) *Attorney, Agent, or Firm*—Troxell Law Office PLLC

(57) ABSTRACT

A multi-element pen, particularly a pen with twin heads containing at least three operating elements for writing, correction or marking, allowing the user use only one pen for writing and correction. The pen includes a body that houses three or more ink-storage rooms and operating elements of different applications, each operating element corresponding an ink-storage room. Different writing inks or correction liquid contained in the ink-storage rooms enables the use different operating elements for writing, correction or marking, allowing the user carry only one pen for writing, correction and marking.

4 Claims, 4 Drawing Sheets

MULTI-ELEMENT PEN

BACKGROUND OF THE INVENTION

While it is a common practice to have more than 1 pen plus correction liquid for different writing, recording, taking note or revision, none of the multi-purpose pens, including the correction pens with refilling correction liquid remain available only for pens of only one purpose. The conventional white-ink correction liquid currently available on the market that allows rewriting on it using ordinary inks contains toxic gases that are harmful to human beings. On the other hand, when applied, the writer must wait until it becomes dry before keeping on writing and, the dried bumpy material troubles the handwriting too. Consequently, environmental correction liquids made of nontoxic substances have become available; having no defects and toxic substances the conventional white-color correction liquids do as the correction liquid itself decomposes the original ink and allows a second writing using a special ink. This is to say, to use the new correction liquid, the user must carry a pen containing the correction liquid and separate a case and a pen that contains the special ink. The pens of different applications the user is supposed to carry would bother the user when it comes to handiness.

The twin-bead pens, mostly markers, available on the market are for 2 purposes and do not meet physical needs. The ball pens of 6~12 colors come with a very complicated mechanism controlling the pop-out, snap-in of the different leads, besides the thick tube makes it inconvenient to carry.

SUMMARY OF THE INVENTION

The multi-element pen referred in this invention relates to a pen containing aquatic ink or correction refill liquid including a body that contains on the inside and both ends at least 3 storage rooms for inks and the writing and correction elements in equal number of the storage rooms, each corresponding to a storage assembly forming an operating unit which, by means of the different writing inks and the non-toxic environmental correction liquids contained in the storage rooms, defines the different operating units for writing, correction and re-writing, thus allowing the user to carry only one pen with different operating units to fulfill writing, correction and re-writing on correction spots using the special ink.

DETAILED DESCRIPTION OF PREFERRED EMBODIMENTS

Figure 1:
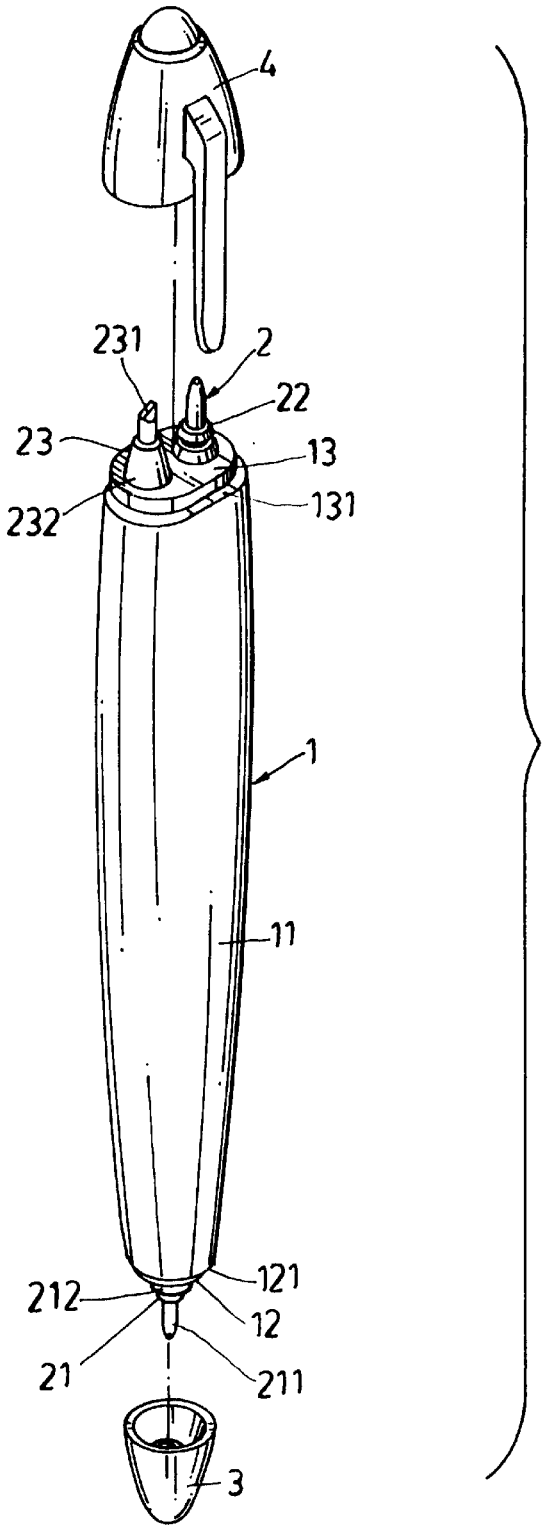
FIG. 1 is an exploded perspective view of the first embodiment of the invention.
Figure 3:
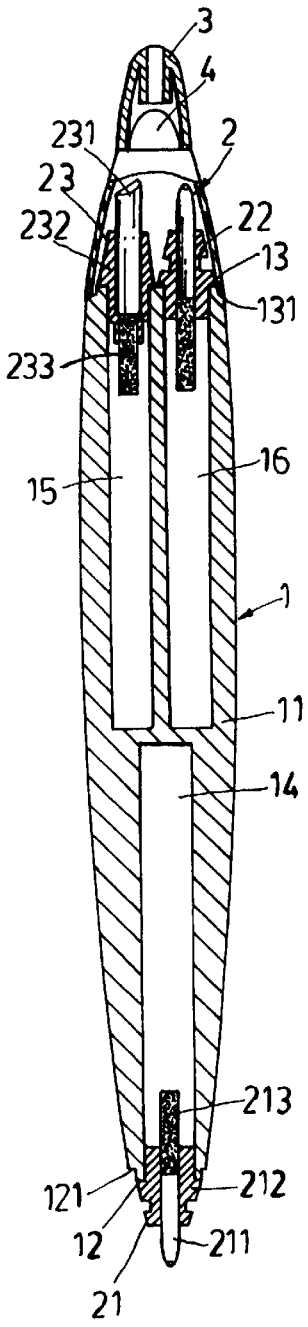
FIG. 3 is an exploded cross-sectional view of the first embodiment of the invention.
Figure 2:
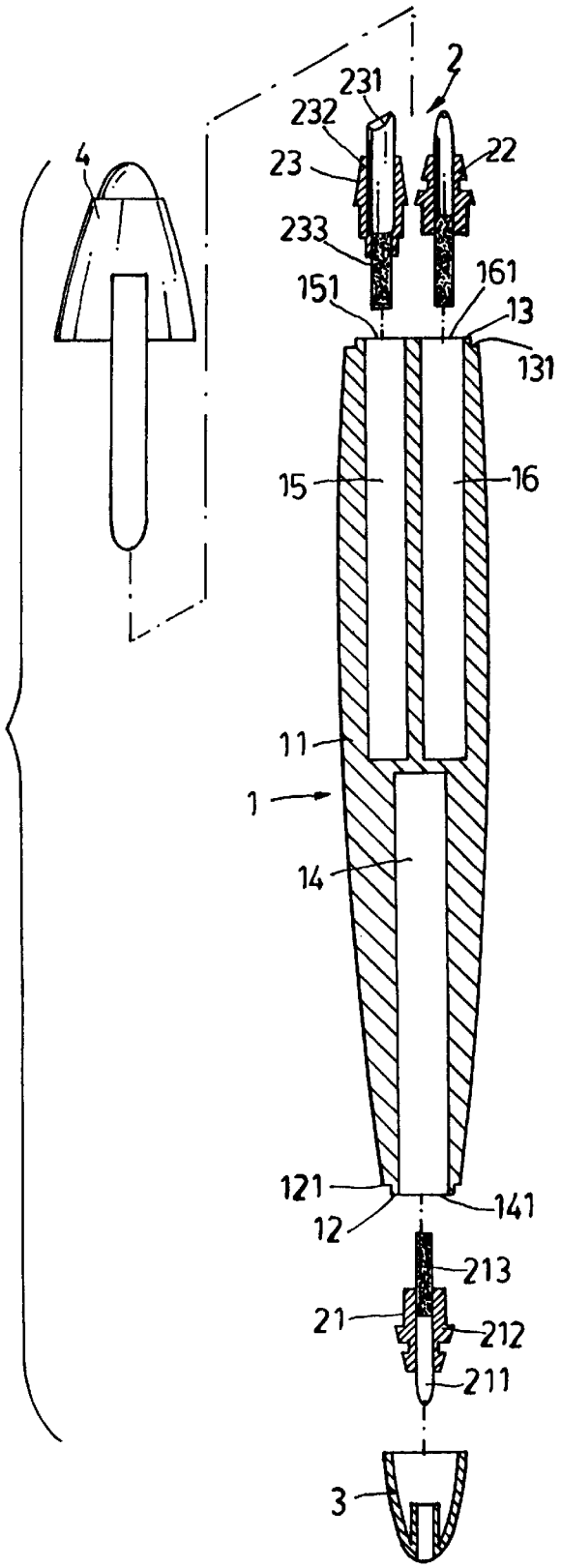
FIG. 2 is an exploded cross-sectional view of the first embodiment of the invention.

As shown in FIGS. 1–3, the first embodiment of this invention includes a pen structure consisting of body 1, element 2 and caps 3, 4 (as shown in FIG. 2), where:

Body 1 (as shown in FIG. 2) includes a hollowed pen tube 11 and two ends 12, 13 of the pen tube 11 are formed with unequal inner diameters. Between the two ends, 12, 13 of the unequal inner diameters the streamlined pen tube 11 is formed for easy carrying or holding in a user's pocket. The hollowed pen tube 11 has its inner diameter partitioned to house three storage rooms 14, 15 and 16. To match the different inner diameters of the hollowed pen tube 11, the first storage room 14 is placed separately in the pen tube 11 near the tapered end 12 and, on the tube end 12, there is the opening 141 of the first storage room 14. The second and third storage rooms 15 and 16 are placed in parallel in the pen tube 11 near the end 13 of larger inner diameter, forming openings 151, 161 of the second and third storage rooms 15, 16 on the tube tip 13. On the tips of the two ends 12 and 13, the recessed necks 121, 131 are formed, allowing the positioning of caps 3, 4.

The three aforementioned storage rooms 14, 15 and 16 are provided with a depth of not more than the half of the overall length of the pen tube 11, for storage of ink in equal volume or unequal volume. To make the physical use easier, the first storage room 14 shall be defined as the larger storage room for ordinary writing ink and the second and the third storage rooms 15, 16 shall be respectively defined as smaller storage rooms for correction liquid and rewriting ink as an ordinary consumer may demand.

The correction liquid filled in said second storage room 15 can be an ordinary white-color correction liquid. In this embodiment, we would propose the use of the transparent, non-toxic and environmental correctional liquid. The use of this correction liquid allows immediate rewriting after erasing ordinary ink without having to wait for it to dry and no bumpy paint or toxic substance remains or is produced. Only the rewriting shall be made using the special ink.

The aforementioned operating unit 2 (as shown in FIG. 2) includes two writing elements 21, 22 for ordinary writing and rewriting after erasing, respectively, and, the erasing element 23 for ordinary writing ink.

The two writing elements 21 and 22 may have the same structure. Said writing unit 21 has a writing element 211 that can be a steel ball pen tip, ball pen tip or a pen. In this embodiment, a steel ball pen tip is used. An ink guide core 213 is in connection with the end of the writing element 211 inserted into the storage rooms 14 or 16 to suck ink for the use of the writing element 211. A sealing kit 212 is located between the writing element 211 and the ink guide core 213 to link the writing element 211 and the ink guide core 213.

Said correction element 23 can be a known marker or the correction writing element of a marker. Correction element 23 has a correction element 231 with its end inserted and positioned into a sealing element 232 while the other end of the sealing element 232 has an ink guide core 233 in connection with the correction element 231 for the supply of correction ink. By means of direct matching of the sealing element 232 with the storage room 15, the ink guide core 233 can be inserted into the second storage room 15 to absorb the correction liquid.

The caps 3, 4 are connected to tube ends 12, 13 in the corresponding tube 11 and the recessed necks 121, 131. When either of the two caps 3, 4 are removed, they can be linked to the other end cap (as shown in FIG. 3) so they will not get lost. Again cap 4 may cover the writing element 22 and the correction element 23 as shown in FIG. 1, or the pair of writing elements 21, 22 and the correction element 23 may have individual caps.

Said assembly forms a pen with ordinary writing, correction and rewriting features (as shown in FIGS. 1, 2). When the user needs to correct mistakes writing with the writing element (21) using ordinary ink (as shown in FIG. 3), all he/she has to do is open the cap 4 and erase the mistake using the correction element 231 before re-writing with the special ink in the writing element 22.

Figure 5:
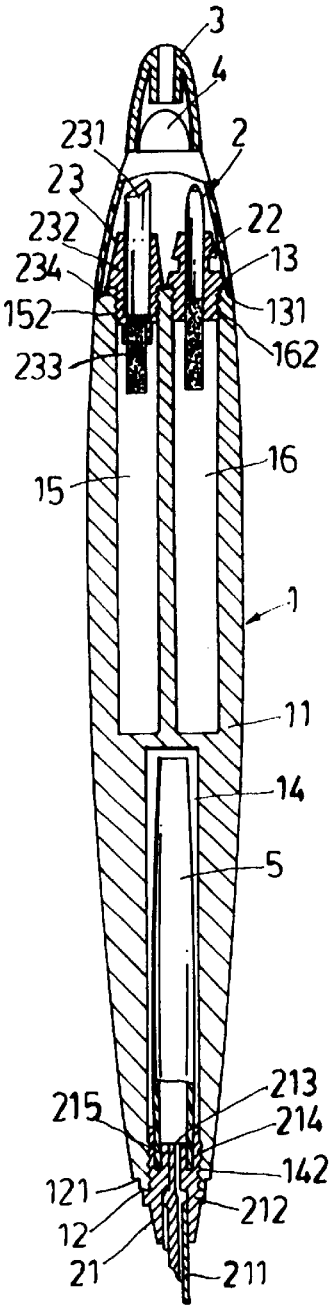
FIG. 5 is an assembled cross-sectional view of the second embodiment of the invention.
Figure 4:
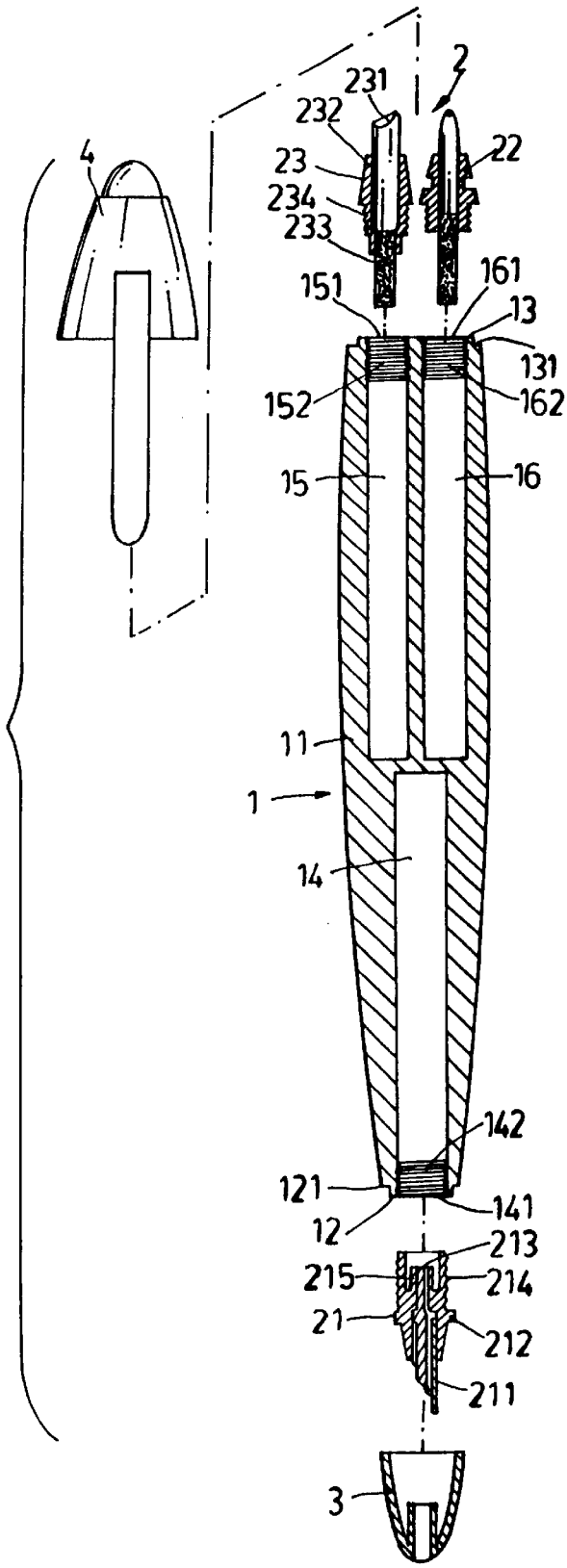
FIG. 4 is an exploded cross-sectional view of the second embodiment of the invention.

As shown in FIGS. 4 and 5, another embodiment of this invention and the structure of an ink cartridge is illustrated The structure includes a pen 1, the element 2 and the caps 3, 4, where:

Pen body 1 includes a hollowed pen tube 11 that has three storage rooms 14, 15 and 16 between the two ends 12, 13 of unequal inner diameters. The three ink storage rooms 14, 15 and 16 have openings 141, 151 and 161 in the tube ends 12 and 13 having threads 142, 152 and 162. On the two ends 12, 13, there are recessed necks 121, 131 to position the caps 3 and 4.

The structure of the two writing elements 21 and 22 includes writing element 211 as in the aforementioned embodiment, can be a steel ball pen tip, ball pen tip or a pen. In this embodiment, a pen is illustrated. The writing elements include a sealing element 212 that corresponds to one of the openings 141, 161, with threads 214 (as shown in FIG. 4) on the outer wall, allowing the sealing elements 212 to engage ends 12, 13. In the sealing element 212, there is an ink guide core 213 that links the cartridge ink tube 5 through the cartridge tube 215 on the tip of the sealing element 212. At the same time, the cartridge ink tube 5 is contained in the storage rooms 14 and 16, where the writing element 211 and sealing element 212 can be easily removed for the replacement of the cartridge ink tube 5.

The structure of said correction element 23, includes the erasing element 211 as in the aforementioned embodiment. On one end of the sealing element 232, there are threads 234 (as shown in FIG. 4) on the outer wall, allowing the sealing element 232 be a free threading element in the storage room 15. In the sealing element 213, there is an ink guide core 233 that links the cartridge ink tube 5 containing non-toxic environmental transparent correction liquid through the cartridge tube 5 on the tip of the sealing element 232. At the same time, the cartridge ink tube 5 is contained in the storage room 15, where the writing element 231 and sealing element 232 can be easily removed for the replacement of the cartridge ink tube 5.

The assembled structure provides a handy pen with two elements on the one end and, one on the other, the storage of ink in the cartridge ink tube 5 and the threading of the sealing elements 212 and 232 to allow easy replacement of element 2 and the cartridge ink tube 5.

Figure 6:
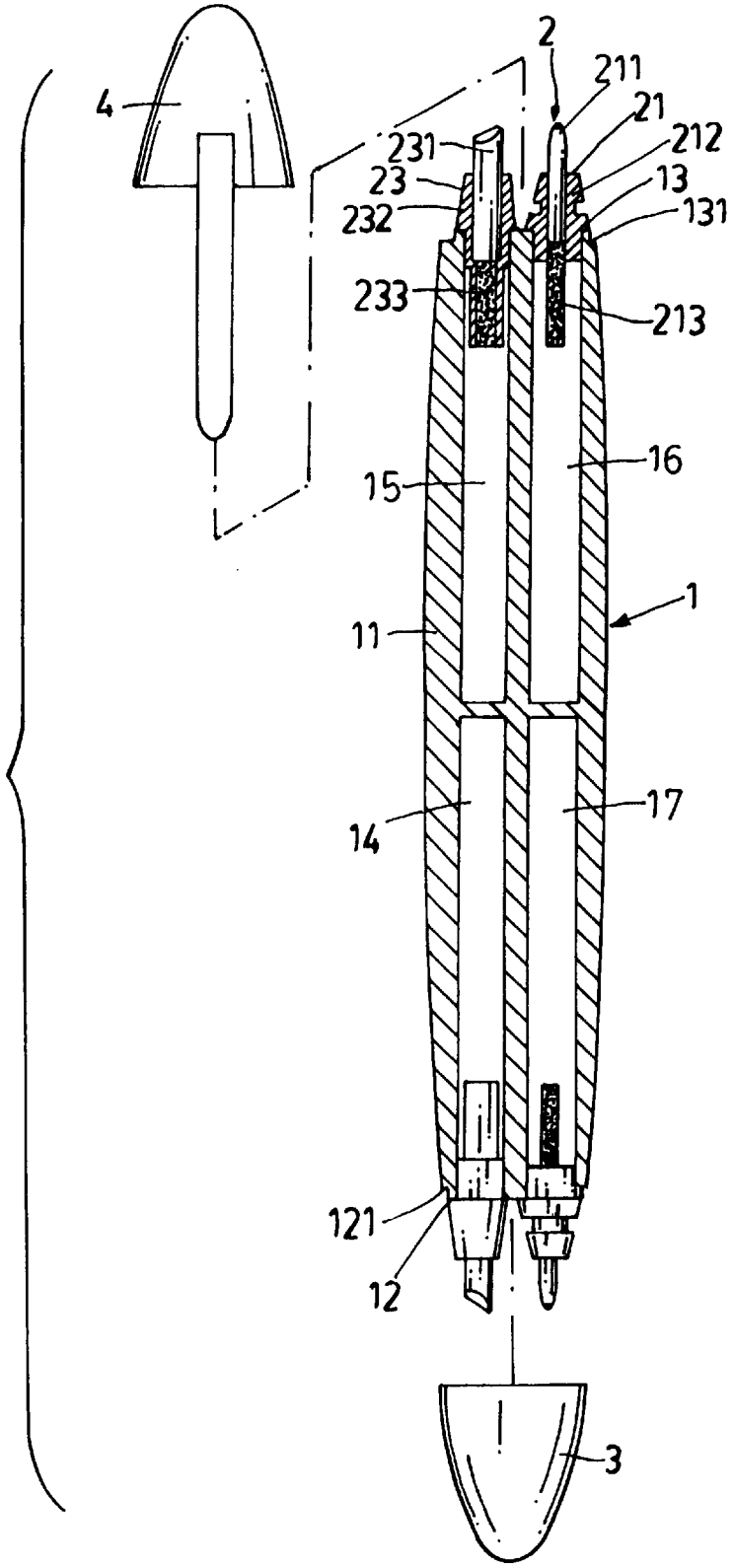
FIG. 6 is an exploded cross-sectional view of the third embodiment of the invention.

FIG. 6 shows a third embodiment containing four elements for ordinary writing, correction, rewriting and marker or a note pen. The element 2 of the pen may feature the writing element 21 or correction element 23 or marking element. Likewise, element 2 comes with a sealing element 212, with one end containing, depending on the application, writing element 211 or erasing element 231. The sealing element 212 may include direct sealing elements in the storage rooms 14, 15, 16 and 17 as shown in the first embodiment, or threads as shown in the second embodiment.

Body 1 includes a hollowed pen tube 11, of which the hollowed inner diameter provides four storage rooms 14, 15, 16 and 17, where the first and the fourth storage rooms 14 and 17 are placed in parallel near the tube end 12, with the tube end 12 having openings of the first and the fourth storage rooms 14 and 17 for securing of two elements 2. The second and the third storage rooms 15 and 16 are placed in parallel near the tube end 13 of pen tube 11, with the tube end 13 forming the second and the third storage rooms with openings that are secured (by direct sealing or threaded sealing) with two elements 2. On the ends 12 and 13 of the tubes, there are recessed necks 121 and 131 to position caps 3, and 4.

What is claimed is:

1. A multi-element ink writing and correcting pen comprising:

a) an elongated, unitary, generally cylindrical pen tube having two opposite ends of unequal diameters, a diameter of a first end being less than a diameter of a second end, an interior of the pen tube forming at least three separate storage rooms including a writing ink storage room having a first opening at the first end, a correction ink storage room having a second opening at the second end, and a rewriting ink storage room adjacent to the correction and storage rooms and having a third opening through the second end of the pen tube;

b) a supply of writing ink in the writing and storage room;

c) a supply of correction ink in the correction ink storage room;

d) a supply of rewriting ink in the rewriting and storage room;

e) a first writing element removably connected to the first end of the pen tube in the first opening;

f) a second writing element removably connected to the second end of the pen tube in the third opening; and, g) a correction element removably connected to the second end of the pen tube in the second opening whereby the correction element is located adjacent to the second element.

2. The multi-element ink writing and correcting pen of claim 1 further comprising:

a) a first cap removably attached to the first end so as to cover the first writing element; and, b) a second cap removably attached to the second end so as to cover both the second writing element and the correction element, at least one of the first and second caps including a portion to which the other of the first and second caps may be attached when removed from the pen tube.

3. The multi-element in writing and correcting pen of claim 1 wherein the first writing element is selected from the group consisting of a steel ball pen tip, a ball pen tip and a pen nib.

4. The multi-element in writing and correcting pen of claim 1 wherein the second writing element is selected from the group consisting of a steel ball pen tip, a ball pen tip and a pen nib.

* * * * *